United States Patent [19]

Green et al.

[11] 4,401,482

[45] Aug. 30, 1983

[54] FE—CR—CO MAGNETS BY POWDER METALLURGY PROCESSING

[75] Inventors: Martin L. Green; Richard C. Sherwood, both of New Providence, N.J.

[73] Assignee: Bell Telephone Laboratories, Incorporated, Murray Hill, N.J.

[21] Appl. No.: 328,231

[22] Filed: Dec. 7, 1981

Related U.S. Application Data

[63] Continuation of Ser. No. 123,691, Feb. 22, 1980, abandoned.

[51] Int. Cl.[3] ..... H01F 1/02

[52] U.S. Cl. ..... 148/104; 148/102; 419/36; 419/38

[58] Field of Search ..... 148/102, 103, 104, 105, 148/126; 75/211; 419/1, 36, 37, 38, 65, 44

[56] References Cited

U.S. PATENT DOCUMENTS

| | | | |
|---|---|---|---|
| 2,546,047 | 3/1951 | Studders | 148/126 |
| 3,901,742 | 8/1975 | Facaros | 148/105 |
| 3,954,519 | 5/1976 | Inoue | 148/31.57 |
| 3,970,485 | 7/1976 | Doser | 148/105 |
| 4,075,437 | 2/1978 | Chin et al. | 148/108 |
| 4,174,983 | 11/1979 | Chin et al. | 148/102 |

OTHER PUBLICATIONS

*Treatise on Powder Metallurgy,* Claus G. Goetzel, Interscience Publishing Inc., New York, vol. 1, 1949, pp. 254–255.

*Primary Examiner*—John P. Sheehan
*Attorney, Agent, or Firm*—Peter A. Businger

[57] ABSTRACT

Fe—Cr—Co alloys have found application in the manufacture of permanent magnets on account of magnetic properties such as, high coercive force, remanent magnetization, and energy product. A method is disclosed for producing magnetic articles comprising Fe, Cr, and Co from powders comprising elemental or pre-alloyed particles. A powder is mixed with an essentially noncarbonizing organic binder, compressed, heated to remove binder, sintered, and aged. Heating results in essentially complete removal of binder prior to sintering.

Magnetic bodies produced according to the disclosed method typically comprise less than 1 weight percent of undesirable nonmagnetic phases and have a maximum energy product of at least 1 million gauss oersted.

7 Claims, No Drawings

FE—CR—CO MAGNETS BY POWDER METALLURGY PROCESSING

CROSS-REFERENCE TO RELATED APPLICATIONS

This is a continuation application of application Ser. No. 123,691, filed Feb. 22, 1980 abandoned.

FIELD OF THE INVENTION

The invention is concerned with powder metallurgy processing of magnetic materials.

BACKGROUND OF THE INVENTION

Particularly advantageous for the production of intricately shaped metallic parts is a technology known as powder metallurgy which comprises methods comprising steps of compressing metallic or precursor powders into desired shape and sintering of fusing to produce a cohesive metallic body. In some instances a compact of metallic particles may have sufficient cohesion or "green strength" upon compression to allow handling; in others, a binder material is admixed prior to compression to insure adequate green strength.

Powder metallurgy processing has been used in the manufacture of magnets as disclosed, e.g., in U.S. Pat. No. 3,901,742, issued to G. Facaros on Aug. 26, 1975. Specifically disclosed is the manufacture of cobalt plus rare earth magnets by steps of compressing a powder to which an organic binder is admixed, removal of the binder by means of a solvent, and sintering.

Due largely to rising prices of cobalt, interest has developed recently in magnetic materials comprising lower amounts of cobalt. Among such materials are alloys which comprise Fe, Cr and Co and which have magnetic properties of high coercive force, high remanent magnetization, and high energy product as disclosed in U.S. Pat. No. 4,075,437, issued Feb. 21, 1978 to G. Y. Chin et al, and U.S. Pat. No. 4,164,893, issued Nov. 20, 1979 to G. Y. Chin et al. So far, these alloys have been produced by melt practice and thermomechanical processing; it would be desirable, however, to produce intricately shaped Fe—Cr—Co magnets by powder metallurgy processing.

SUMMARY OF THE INVENTION

The invention is a method for producing Fe—Cr—Co magnetic articles from powders which comprise elemental or pre-alloyed particles. A powder preferably comprises at least 50 weight percent, Fe, at least 10 weight percent Cr, and at least 1 weight percent Co and is mixed, according to the invention with a noncarbonizing organic binder. Preferred amounts of binder are in a range of 0.1–10 weight percent, amounts towards the lower end of such range being preferred when elemental metallic powders are used.

A mixture of metallic particles and binder is compacted under pressure in a mold having desired shape, and binder is removed essentially completely by heating. Sintering is by heating at temperatures which preferably correspond to a predominantly single phase alpha state of an alloy. After sintering magnetic properties are developed by an aging heat treatment which may be in the presence of a magnetic field. Resulting magnets typically contain less than 1 weight percent undesirable nonmagnetic phases and have a maximum energy product of at least 1 million gauss oersted.

DETAILED DESCRIPTION

Magnetic articles are made from powders comprising elemental or pre-alloyed constituents Fe, Cr, and Co, preferably in amounts of at least 50 weight percent Fe, at least 10 weight percent Cr, and at least 1 weight percent Co. In addition to amounts of Fe, Cr, and Co as specified, alloys may comprise elements such as e.g., Cu, Ni, Zr, Mo. Nb, V, Ti, Al, Mn, Si, Mg, or Ca as have been incorporated in wrought alloys for various purposes. Moreover, presence of trace amounts of undesirable elements such as, e.g., C, N, S, and O may be unavoidably present when commercial grade raw materials are used. Powders may comprise pre-alloyed particles having desired composition; they may comprise elemental particles in desired proportion; or they may comprise a mixture of pre-alloyed and elemental particles.

Powders may conveniently be produced by atomizing equipment which serves to break up a flow of melted material into droplets by means of a strong flow of a gas. A flow of molten material may typically be gravity fed through an orifice and gas may be aimed at the orifice circumferentially and having a downward velocity component. Droplets solidify, and resulting particles are collected in a receptacle. Particle size may be in the approximate range of 1–1000 micrometer; a range of 10–300 micrometers is considered more typical. Particles preferably are −50 mesh, i.e., they pass through a 50 mesh sieve.

At least one organic binder material is admixed to the powder of metallic particles, preferred binders of the invention being essentially noncarbonizing in the sense that removal of binder by heating results in no appreciable carbon residue. A binder substance typically has molecular weight greater than or equal to 180 and, in the case of an acidic binder, molecular weight per acid group greater than or equal to 180. Binder may optionally be dissolved in a suitable solvent.

Among suitable binder substances are fatty acids, amides of fatty acids, and esters of fatty acids (both mono- and polyfunctional); specific examples are stearic acid, stearamide, erucamide, N,N' ethylene bis stearamide, N,N' ethylene bis oleamide, and saturated triglycerides. Also suitable are noncarbonizing polymers such as, e.g., methacrylate polymers and polyethylene glycols. These are contrasted with less desirable, carbonizing binders such as, e.g., acrylic polymers.

Preferred amounts of binder are in the range of 0.1–10 weight percent of the resulting mixture and preferably in the range of 0.1–6 weight percent. Amounts of binder towards the lower end of the preferred range and, more specifically, of less than 1 weight percent are sufficient when predominantly elemental powders are used. Such predominantly elemental powders tend to be softer, to have greater plasticity, and thereby to develop green strength at least in part by cold welding of particles. For powders comprising a substantial amount of pre-alloyed particles, amounts of at least 1 weight percent binder are preferred in the interest of sufficient green strength. Excessive amounts of binder tend to lead to collapse of a compact in the course of heating to sintering temperature.

The mixture of binder and metallic particles is compacted under pressure in a mold having desired shape, resulting in a compacted body in which density of combined metallic components typically is in an approximate range of 50–75 percent of bulk metallic density.

Preferred compacting pressure is greater than or equal to 20 kpsi; compacting may optionally be at temperature above room temperature.

A compact is heated so as to remove binder prior to sintering, essentially complete removal of binder being in the interest of ultimate magnetic properties of a sintered and aged magnet. Essentially complete removal of binder may occur in the course of sufficiently slow heating to sintering temperature; alternatively, removal may be effected in a separate heating step prior to sintering. In either case heating is preferably in a nonoxidizing atmosphere.

According to the invention, use of an essentially noncarbonizing binder is advantageous in view of an observed detrimental influence of residual carbon on magnetic properties of a sintered article. More specifically, at low cobalt levels and, in particular, at cobalt levels below approximately 10 weight percent, residual carbon is believed to act primarily as a diluent, thereby reducing magnetic properties of remanent magnetization and magnetic energy product. At higher levels of cobalt, detrimental influence of residual carbon is even more pronounced and understood to be due additionally to the stabilization of undesirable nonmagnetic phases such as, e.g., sigma and gamma phases and complex carbides whose presence may be ascertained by techniques such as, e.g., metallography, X-ray analysis, or electron microscopy. Accordingly, and in the interest of producing magnets having a maximum energy product of at least 1 million gauss orested, undesirable nonmagnetic phases are preferably limited to amounts of less than 1 weight percent.

After removal of binder, sintering is carried out by heating at temperatures which are below the melting point and which typically are at least 1100 degrees C., higher temperatures being preferable at higher cobalt levels. Preferred sintering temperatures correspond to a single phase alpha state of an alloy; alternately, alpha phase may be developed after low-temperature sintering by an additional, high-temperature anneal. Sintering may involve the formation of a liquid phase of an alloy component as may be the case, e.g., when a metallic powder comprises particles of a low-melting Cr—Co alloy. Sintering atmosphere is preferably nonoxidizing; neutral or reducing atmospheres comprising, e.g., Ar, N, He, cracked ammonia, or H are appropriate.

In the course of sintering, a shaped article shrinks, final density typically being in a range of 85–95 percent of bulk density. In the interest of desired magnetic properties, sintered density is maximized. High sintered density is also beneficial in the interest of physical strength of a sintered article as indicated, e.g., where magnets are used under stress due to rapid rotation. A sintered body is preferably subjected to an aging treatment which preferably is in the presence of a magnetic field so as to optimize magnetic properties.

Specific examples are presented below to illustrate production of Fe—Cr—Co magnetic articles according to the invention. Achieved magnetic properties are considered typical but may be further increased by optimization of processing parameters such as, e.g., aging time and temperature.

EXAMPLE 1

Elemental powders of Fe, Cr, and Co were mixed with stearic acid by ball milling for 2 hours using alumina balls. Metallic components were 31 weight percent Cr (particle size 2 micrometers), 5 weight percent Co (−325 mesh), and remainder essentially Fe (−200 mesh); stearic acid was 1 weight percent of the mixture. The mixture was compressed into a cylindrical compact having a diameter of 0.388 in. and a length of 0.5 in. by uniaxial compaction at a pressure of 70 kpsi. The compact was placed in a tube furnace in an atmosphere of purified hydrogen flowing at a rate of 0.8 liter per minute. Binder was volatilized by the time temperature had reached about 600 degrees C.; sintering was at a temperature of 1410 degrees C. for 8 hours.

Magnetic properties were developed by an aging heat treatment consisting of heating to a temperature of 630 degrees C., cooling at a rate of 0.9 degrees C. per hour to a temperature of 500 degrees C., and air cooling to room temperature. Aging was in a magnetic field of 1250 oersted in the direction of the axis of the sample. The resulting magnet had relative density of 96.8 percent, coercive force $H_c=500$ oersted, remanent magnetization $B_r=12{,}300$ gauss, and maximum energy product $(BH)_{max}=4.35$ million gauss oersted.

EXAMPLE 2

Elemental powders of Fe, Cr, Co and a prealloyed Fe-68.5 weight percent Ti powder were mixed with stearic acid by ball milling for 2 hours using alumina balls. Metallic components were 30 weight percent Cr, 5 weight percent Co, 0.5 weight percent Ti, and remainder essentially Fe. Cr powder had 2 micrometer particle size, Co powder was −325 mesh, Fe powder was −200 mesh, and Fe—Ti powder was −100 mesh. Stearic acid was 0.5 weight percent of the mixture.

The mixture was compressed into a cylindrical compact having a diameter of 0.388 in. and a length of 0.5 in. by uniaxial compaction at a pressure of 70 kpsi. The compact was placed in a tube furnace in an atmosphere of purified argon flowing at a rate of 0.8 liter per minute. Binder was volatilized by the time temperature reached about 600 degrees C.; sintering was at first and second temperatures of 1240 degrees for 2 hours and 1340 degrees C. for 8 hours.

Magnetic properties were developed by an aging heat treatment consisting of heating to a temperature of 630 degrees C., cooling at a rate of 0.9 degrees C. per hour to a temperature of 500 degrees C., and air cooling to room temperature. Aging was in a magnetic field of 1000 oersted in the direction of the axis of the sample. The resulting magnet had a relative density of 94.2 percent, coercive force $H_c=430$ oersted, remanent magnetization $B_r=11{,}700$ gauss, and maximum energy product $(BH)_{max}=2.89$ million gauss oersted.

EXAMPLES 3

A −100 mesh pre-alloyed powder comprising 29.5 weight percent Cr, 25 weight percent Co, 3 weight percent Mo, and remainder essentially Fe was produced by atomizing a melt by means of a flow of argon gas. The powder was mixed with 5 weight percent saturated triglycerides as a binder by ball milling for 2 hours using alumina balls. The mixture was compressed into a cylindrical compact having a diameter of 0.388 in. and a length of 0.5 in. by uniaxial compaction at a pressure of 43.4 kpsi. The compact was placed in a tube furnace in an atmosphere of purified argon flowing at a rate of 0.8 liter per minute. Binder was volatilized by the time temperature had reached about 600 degrees C.; sintering was at a temperature of 1310 degrees C. for 50 hours. The sintered body was removed from the furnace under a blanket of argon and quenched into ice water.

Magnetic properties were developed by an aging heat treatment according to the following schedule; 640 degrees C. for 30 minutes, furnace cool to 600 degrees C. for 2 hours, furnace cool to 580 degrees C. for 2 hours, furnace cool to 550 degrees C. for 16 hours, and air cool to room temperature. Aging was in a magnetic field of 1000 oersted in the direction of the axis of the sample. The resulting magnet had a relative density of 92.5 percent, coercive force $H_c=945$ oersted, remanent magnetization $B_r=9000$ gauss, and maximum energy product $(BH)_{max}=3.52$ million gauss oersted.

EXAMPLE 4

Elemental powder of Fe and a pre-alloyed Cr-20 weight percent Co powder were mixed with stearic acid by ball milling for 2 hours using alumina balls. Metallic components were 26 weight percent Cr, 6.5 weight percent Co, and remainder essentially Fe. Fe powder was −200 mesh and Cr—Co powder was −150 mesh. Stearic acid was 1 weight percent of the mixture. The mixture was compressed into a cylindrical compact having a diameter of 0.388 in. and a length of 0.5 in. by uniaxial compaction at a pressure of 70 kpsi.

The compact was placed in a tube furnace in an atmosphere of purified hydrogen flowing at a rate of 0.8 liter per minute. Binder was volatilized by the time temperature reached about 600 degrees C.; sintering was at a temperature of 1350 degrees C. for 8 hours. The sintered body was removed from the furnace under a blanket of hydrogen and quenched into ice water.

Magnetic properties were developed by an aging heat treatment consisting in heating to a temperature of 650 degrees C., cooling at a rate of 2 degrees C. per hour to 500 degrees C., and air cooling to room temperature. Aging was in a magnetic field of 1000 oersted in the direction of the axis of the sample. The resulting magnet had a density of 98.7 percent, coercive force $H_c=276$ oersted, remanent magnetization $B_r=13{,}500$ gauss, and maximum energy product $(BH)_{max}=1.84$ million gauss oersted.

We claim:

1. Method for producing a magnetic body, said method comprising sintering and aging a compact, said compact having been obtained by compressing a mixture, said mixture comprising metallic particles and a binder material, said method comprising heating prior to sintering to remove said binder from said compact, said mixture comprising at least 50 weight percent Fe, at least 10 weight percent Cr, at least 1 percent Co, and at least 0.1 weight percent of said binder, and said binder consisting essentially of at least one binder material which is selected from the group consisting of fatty acids, amides of fatty acids, and esters of fatty acids, whereby the presence of detrimental nonmagnetic phases in said body is minimized.

2. Method of claim 1 in which said binder material is present in said mixture in an amount of less than or equal to 10 weight percent.

3. Method of claim 1 in which said binder material is present in said mixture in an amount of less than or equal to 6 weight percent.

4. Method of claim 1 in which metallic particles in said mixture predominantly are pre-alloyed particles and in which said binder material is present in said mixture in an amount of at least 1 weight percent.

5. Method of claim 1 in which said body has a maximum energy product which is greater than or equal to 1 million gauss oersted and in which said detrimental nonmagnetic phases are present in combination in an amount of less than 1 weight percent.

6. Method of claim 1 in which said particles pass through a 50 mesh sieve.

7. Method of claim 1 in which compressing said mixture is at a pressure which is greater than or equal to 20 kpsi.

* * * * *

UNITED STATES PATENT AND TRADEMARK OFFICE

CERTIFICATE OF CORRECTION

PATENT NO. : 4,401,482

DATED : August 30, 1983

INVENTOR(S) : Martin L. Green and Richard C. Sherwood

It is certified that error appears in the above-identified patent and that said Letters Patent is hereby corrected as shown below:

Column 1, line 40, "4,164,893" should read --4,174,983--.

Signed and Sealed this

*Fifteenth* Day of *November 1983*

[SEAL]

*Attest:*

GERALD J. MOSSINGHOFF

*Attesting Officer*

*Commissioner of Patents and Trademarks*